US010102747B2

(12) United States Patent
Gage et al.

(10) Patent No.: US 10,102,747 B2
(45) Date of Patent: Oct. 16, 2018

(54) INTERSECTION TRAFFIC SIGNAL INDICATOR SYSTEMS AND METHODS FOR VEHICLES

(71) Applicant: Toyota Motor Engineering & Manufacturing North America, Inc., Erlanger, KY (US)

(72) Inventors: Sergei I. Gage, Redord, MI (US); Arata Sato, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 0 days.

(21) Appl. No.: 15/232,866

(22) Filed: Aug. 10, 2016

(65) Prior Publication Data

US 2018/0047286 A1 Feb. 15, 2018

(51) Int. Cl.

*G08G 1/09* (2006.01)
*G08G 1/0967* (2006.01)
*G08G 1/07* (2006.01)

(52) U.S. Cl.

CPC ..... *G08G 1/096783* (2013.01); *G08G 1/07* (2013.01); *G08G 1/096716* (2013.01); *G08G 1/096758* (2013.01); *G08G 1/096791* (2013.01)

(58) Field of Classification Search

CPC ..... G08G 1/096783
USPC ..... 340/905
See application file for complete search history.

(56) References Cited

U.S. PATENT DOCUMENTS

| | | | | |
|---|---|---|---|---|
| 7,145,441 | B2 * | 12/2006 | Knoop | B60Q 9/008 340/435 |
| 8,532,843 | B2 | 9/2013 | Nagura et al. | |
| 9,046,047 | B2 | 6/2015 | Sangameswaran et al. | |
| 9,158,980 | B1 | 10/2015 | Ferguson et al. | |
| 9,261,879 | B2 | 2/2016 | Ferguson et al. | |
| 2013/0063281 | A1 * | 3/2013 | Malaska | G08G 1/096783 340/905 |
| 2016/0293006 | A1 * | 10/2016 | Bauer | G08G 1/095 |

* cited by examiner

*Primary Examiner* — Tanmay Shah
(74) *Attorney, Agent, or Firm* — Dinsmore & Shohl LLP

(57) ABSTRACT

A method of providing current traffic light status information to a driver of an object vehicle for one or more traffic light devices at an intersection is provided. The method includes receiving current traffic light status information by an intersection traffic signal indicator system of the object vehicle from a source external the object vehicle using one or both of vehicle-to-vehicle and vehicle-to-infrastructure communication. The current traffic light status information is indicative of a traffic light of a traffic light device visible to an oncoming vehicle. A reproduction of the traffic light visible to the oncoming vehicle is displayed as a graphic object on a display of the object vehicle using the traffic light status information.

18 Claims, 5 Drawing Sheets

INTERSECTION TRAFFIC SIGNAL INDICATOR SYSTEMS AND METHODS FOR VEHICLES

TECHNICAL FIELD

The present specification generally relates to intersection traffic signal indicator systems and methods for vehicles.

BACKGROUND

Drivers typically rely on observation and experience in determining a traffic signal status for oncoming traffic at an intersection. Determining the traffic signal status of oncoming traffic is often accomplished without any ability to directly perceive the traffic light status of the oncoming traffic as the traffic lights are typically turned toward the oncoming traffic. Frequently, turns are executed at intersections without direct knowledge of the current traffic light status of intersecting and oncoming lanes.

Accordingly, a need exists to provide drivers with current traffic light status of intersecting lanes.

SUMMARY

In one embodiment, a method of providing current traffic light status information to a driver of an object vehicle for one or more traffic light devices at an intersection is provided. The method includes receiving current traffic light status information by an intersection traffic signal indicator system of the object vehicle from a source external the object vehicle using one or both of vehicle-to-vehicle and vehicle-to-infrastructure communication. The current traffic light status information is indicative of a traffic light of a traffic light device visible to an oncoming vehicle. A reproduction of the traffic light visible to the oncoming vehicle is displayed as a graphic object on a display of the object vehicle using the traffic light status information.

In another embodiment, a method of providing current traffic light status information to a driver of an object vehicle for one or more traffic light devices at an intersection is provided. The method includes receiving current traffic light status information by an intersection traffic signal indicator system of the object vehicle from a source external the object vehicle using one or both of vehicle-to-vehicle and vehicle-to-infrastructure communication. The current traffic light status information is indicative of current traffic light status of multiple traffic light devices at the intersection. A reproduction of one or more traffic lights of the multiple traffic light devices is displayed as a graphic object on a display of the object vehicle using the traffic light status information.

In yet another embodiment, a vehicle includes one or more processors and one or more memory modules communicatively coupled to the one or more processors. A network interface module is configured for one or both of vehicle-to-vehicle and vehicle-to-infrastructure communication. A display is provided and machine readable instructions are stored in the one or more memory modules that cause the one or more processors to display a reproduction of a traffic light of a traffic light device at an intersection as a graphic object on the display of the vehicle using traffic light status information received from a source external of the vehicle using one or both of vehicle-to-vehicle and vehicle-to-infrastructure communication. The current traffic light status information is indicative of the traffic light of the traffic light device at the intersection.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein are generally related to intersection traffic signal indicator systems and methods for vehicles. The intersection traffic signal indicator systems can utilize vehicle-to-infrastructure (V2I) and/or vehicle-to-vehicle (V2V) systems to obtain current traffic signal status information of one or more traffic signals available at an intersection that is typically not directly observable by a driver at the intersection under ordinary circumstances. The current traffic signal status information can be used by the vehicle to generate a traffic signal reproduction of the current traffic signal of other lanes of the intersection for display to the driver that can be used by the driver to make informed driving decisions while at the intersection.

It is noted that the present disclosure may be applied to any vehicle. It is contemplated that the vehicle may or may not be an autonomous vehicle or a partially autonomous vehicle. When referring to autonomous or partially autonomous vehicles, it is meant to refer to vehicles having at least one drive mode wherein a human operator is not necessary to guide the vehicle. However, embodiments of the present disclosure are also applicable to fully human drivable vehicles.

Figure 1:
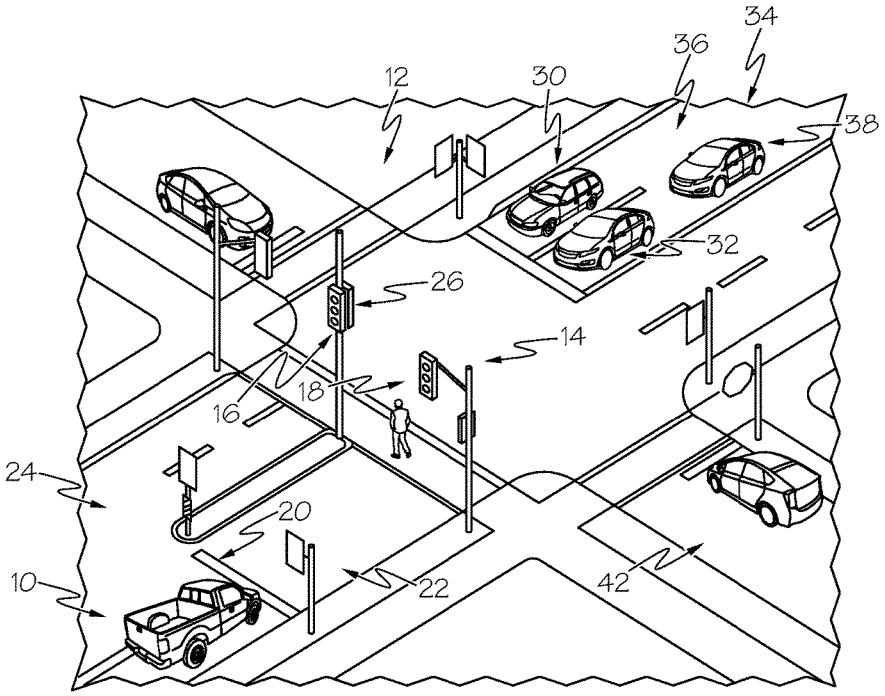
FIG. 1 depicts several vehicles including an object vehicle at an intersection with the several vehicles being located in various lanes of the intersection, according to one or more embodiments shown and described herein.

Referring to FIG. 1, an object vehicle 10 is illustrated at an intersection 12. As used herein, the term "intersection" refers to a location where roadways meet. The term "roadway" is not meant to be limiting and can include any path a vehicle may travel including streets, highways, interstates, parking ingress and egress locations, entrance and exit ramps of other roadways, etc. A traffic signal apparatus 14 is provided at the intersection 12. The traffic signal apparatus 14 may include various traffic signal devices. In this example, traffic signal devices 16 and 18 may be observable from the object vehicle 10. The traffic signal devices 16 and 18 are associated with lanes 20 and 22, respectively, of roadway 24. Similarly, traffic signal device 26 may be observable from oncoming vehicles 30, 32 and 34. The traffic signal device 26 is associated with lane 38 of roadway 40.

The traffic signal devices 16, 18 and 26 provide traffic flow instructions to control traffic flow at the intersection 12. The traffic flow instructions may be, for example, in the form of red, yellow and green lights. The traffic flow instructions, in addition to including red, yellow and green lights may include shapes, such as a turn arrow or other symbols. For example, it can be common for public transportation lanes to include a variety of symbols. Further, traffic signal devices may be provided for pedestrians.

In some instances, it may be possible for the object vehicle 10 to make a traffic move, even though the traffic flow instructions for the object vehicle 10 indicate STOP (i.e., red light). For example, it may be an option (depending on location and restrictions otherwise) for the object vehicle 10 to make a right turn onto roadway 42 with the red light traffic flow instructions from the traffic signal device 18. However, pedestrians and other vehicles may have the right-of-way during such a right turn of the object vehicle 10 with the red light traffic flow instructions. For example, it may not be uncommon for oncoming vehicle 32 to have traffic flow instructions indicating GO (i.e., a green light or green arrow) or go with caution (e.g., a yellow flashing light or arrow). In these instances, the oncoming vehicle 32 may or may not have the right-of-way to turn onto the roadway 42, but is otherwise allowed to make a turn. However, the traffic flow instructions of the oncoming vehicle 32 may not be directly observable by the driver of the object vehicle 10 due to the orientation of the traffic signal device 26. Thus, the driver of the object vehicle 10 may not have direct information regarding the current traffic signal status of the oncoming vehicle 32.

Figure 2:
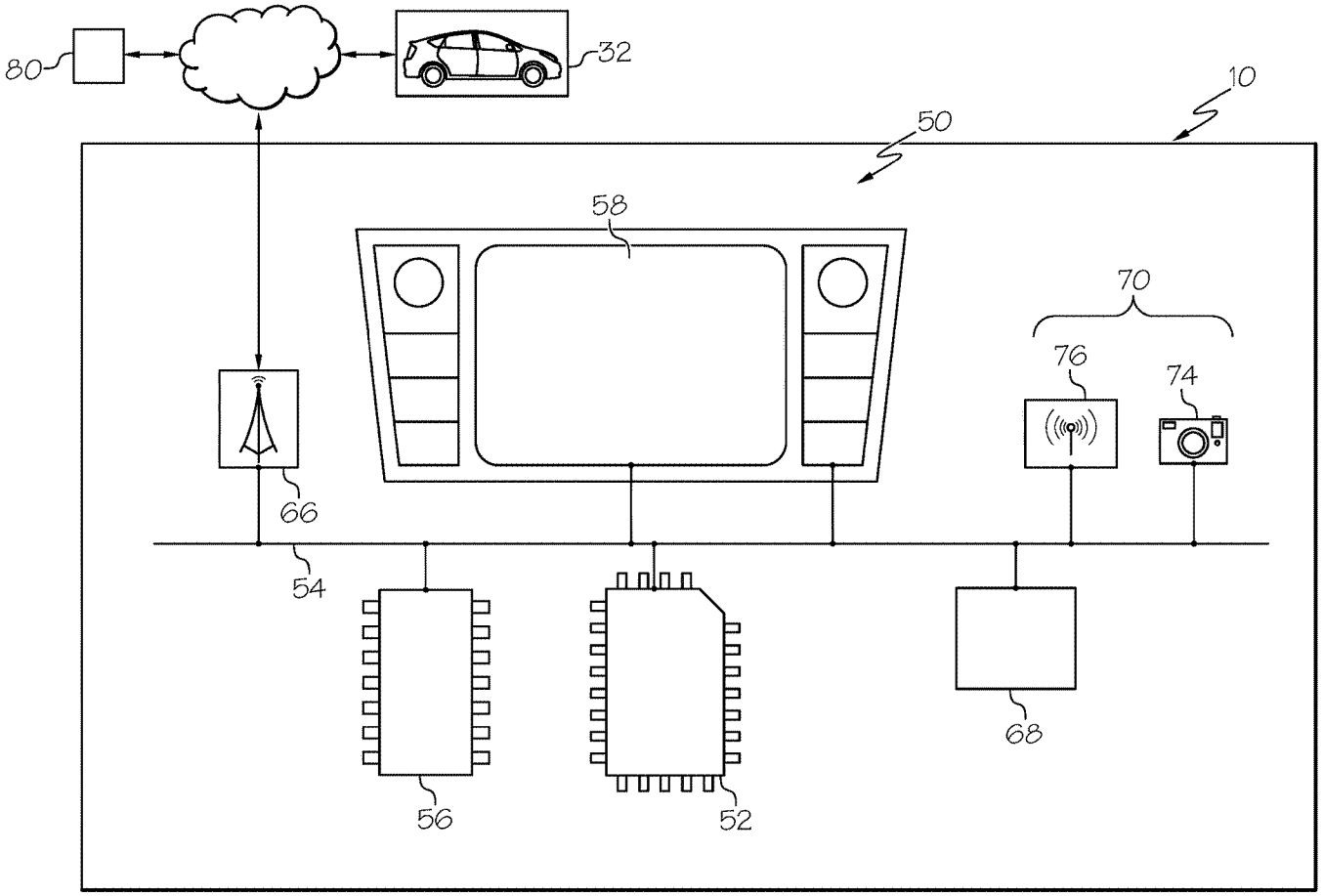
FIG. 2 is a schematic illustration of an intersection traffic indicator system for the object vehicle of FIG. 1, according to one or more embodiments shown and described herein.

Referring to FIG. 2, the object vehicle 10 includes an intersection traffic signal indicator system 50 that utilizes V2I and/or V2V systems to obtain current traffic signal status information of one or more traffic signal devices available to the oncoming vehicle 32 that is not directly observable by the driver of the object vehicle 10. The intersection traffic signal indicator system 50 includes one or more processors 52. Each one or more processor 52 may be any device capable of executing machine readable instructions. Accordingly, each one or more processor 52 may be a controller, an integrated circuit, a microchip, a computer, or any other computing device. The one or more processors 52 are coupled to a communication path 54 that provides signal interconnectivity between various modules. Accordingly, the communication path 54 may communicatively couple any number of processors 52 with one another, and allow the modules coupled to the communication path 54 to operate in a distributed computing environment. Specifically, each of the modules may operate as a node that may send and/or receive data. As used herein, the term "communicatively coupled" means that coupled components are capable of exchanging data signals with one another such as, for example, electrical signals via conductive medium, electromagnetic signals via air, optical signals via optical waveguides, and the like.

Accordingly, the communication path 54 may be formed from any medium that is capable of transmitting a signal such as, for example, conductive wires, conductive traces, optical waveguides, or the like. In some embodiments, the communication path 54 may facilitate the transmission of wireless signals, such as WiFi, Bluetooth, and the like. Moreover, the communication path 54 may be formed from a combination of mediums capable of transmitting signals. In one embodiment, the communication path 54 comprises a combination of conductive traces, conductive wires, connectors, and buses that cooperate to permit the transmission of electrical data signals to components such as processors, memories, sensors, input devices, output devices, and communication devices. Accordingly, the communication path 54 may comprise a vehicle bus, such as for example a LIN bus, a CAN bus, a VAN bus, and the like. Additionally, it is noted that the term "signal" means a waveform (e.g., electrical, optical, magnetic, mechanical or electromagnetic), such as DC, AC, sinusoidal-wave, triangular-wave, square-wave, vibration, and the like, capable of traveling through a medium.

The object vehicle 10 further includes one or more memory modules 56 coupled to the communication path 54. The one or more memory modules 56 may comprise RAM, ROM, flash memories, hard drives, or any device capable of storing machine readable instructions such that the machine readable instructions can be accessed by the one or more processors 52. The machine readable instructions may comprise logic or algorithm(s) written in any programming language of any generation (e.g., 1GL, 2GL, 3GL, 4GL, or 5GL) such as, for example, machine language that may be directly executed by the processor, or assembly language, object-oriented programming (OOP), scripting languages, microcode, etc., that may be compiled or assembled into machine readable instructions and stored on the one or more memory modules 56. Alternatively, the machine readable instructions may be written in a hardware description language (HDL), such as logic implemented via either a field-programmable gate array (FPGA) configuration or an application-specific integrated circuit (ASIC), or their equivalents. Accordingly, the methods described herein may be implemented in any suitable computer programming language, as pre-programmed hardware elements, or as a combination of hardware and software components.

In some embodiments, the one or more memory modules 56 may include a database that includes navigation information and/or map information including information pertaining to traffic signal locations, available traffic signal types, etc. The object vehicle 10 may display on a display 58 road parameters and traffic signal information available from the one or more memory modules 56. In some embodiments, a GPS unit 68 may be provided that can provide a variety of map and traffic signal information for the display 58. As an example, and not a limitation, road parameters may include lane lines, on/off ramps, and barriers. Furthermore, the one or more memory modules 56 may include an image recognition database or algorithm to allow the object vehicle 10 to identify a target object type sensed within a vicinity of the object vehicle 10.

The object vehicle 10 comprises the display 58 for providing visual output such as, for example, maps, navigation, entertainment, information, or a combination thereof. As will be described in greater detail below, the display 58 can also provide visual output of the current traffic signal status for the oncoming vehicle 32 (FIG. 1). The display 58 is coupled to the communication path 54, as shown in FIG. 2. Accordingly, the communication path 54 communicatively couples the display 58 to other modules of the object vehicle 10. The display 58 may include any medium capable of transmitting an optical output such as, for example, a cathode ray tube, light emitting diodes, a liquid crystal display, a plasma display, or the like. Moreover, the display 58 may be a touch screen that, in addition to providing optical information, detects the presence and location of a tactile input upon a surface of or adjacent to the display 58. Accordingly, the display 58 may receive mechanical input directly upon the optical output provided by the display 58. Additionally, it is noted that the display 58 can include at least one of the one or more processors 52 and the one or memory modules 56. As noted above, the display 58 can be at least one of a heads-up display, an instrument cluster display, and a mobile device display. In some embodiments, the object vehicle 10 may have a plurality of displays. In such embodiments, the object vehicle 10 can also have a plurality of different types of displays at various locations within the object vehicle 10. For example, and not as a limitation, the object vehicle 10 can have an in-dashboard display and a heads-up display for displaying information directly on a windshield or window of the object vehicle 10.

In some embodiments, the object vehicle 10 comprises network interface module 66 for communicatively coupling the object vehicle 10 to the oncoming vehicle 32 (FIG. 1) such that data can be sent between the object vehicle 10 and oncoming vehicle 32 (V2V) or other vehicles or infrastructure (V2I). For instance, the object vehicle 10 and oncoming vehicle 32 may send and receive information relevant to current traffic signal status information, speed, road conditions, oncoming obstacles, etc. The network interface module 66 can be communicatively coupled to the communication path 54 and can be any device capable of transmitting and/or receiving data via a network. Accordingly, the network interface module 66 can include a communication transceiver for sending and/or receiving any wired or wireless communication. For example, the network interface module 66 may include an antenna, a modem, LAN port, Wi-Fi card, WiMax card, mobile communications hardware, near-field communication hardware, satellite communication hardware and/or any wired or wireless hardware for communicating with other networks and/or devices. In one embodiment, the network interface module 66 includes hardware configured to operate in accordance with the Bluetooth wireless communication protocol. In another embodiment, network interface module 66 may include a Bluetooth send/receive module for sending and receiving Bluetooth communications to/from a mobile device.

The object vehicle 10 may include one or more sensors 70 communicatively coupled to the one or more processors 52. The one or more sensors 70 may be used in conjunction with V2V or V2I communications. The one or more sensors 70 may include, but are not limited to, cameras, LiDAR, RADAR, and proximity sensors. In some embodiments, multiple types of sensors are used to provide a variety of information to the object vehicle 10.

For instance, FIG. 2 illustrates the object vehicle 10 utilizing a variety of sensors 70. A camera 74 may be coupled to the communication path 54 such that the communication path 54 communicatively couples the camera 74 to other modules of the object vehicle 10. The camera 74 may be any device having an array of sensing devices (e.g., pixels) capable of detecting radiation in an ultraviolet wavelength band, a visible light wavelength band, or an infrared wavelength band. The camera 74 may have any suitable resolution. Some embodiments may include multiple cameras. In operation, the camera 74 may be used to detect a target object such as the oncoming vehicle 32 within a vicinity of the object vehicle 10. The camera 74 and/or the one or more processors 52, based on input from the camera 74, may be able to also determine the type of object the camera 74 is capturing through image recognition capabilities. For example, the camera 74 and/or the one or more processors 52 may be able to determine whether an object is another vehicle, a cyclist, a pedestrian, an animal, landscape, etc.

Still referring to FIG. 2, the object vehicle 10 may further include a second sensor 76 in addition to the camera 74. The second sensor 76 is coupled to the communication path 54 such that the communication path 54 communicatively couples the second sensor 76 to other modules of the object vehicle 10. The second sensor 72 may be any device capable of outputting a signal indicative of the speed, direction of travel, and the general proximity of the oncoming vehicle 32 to the object vehicle 10. In some embodiments, the second sensor 76 may include RADAR, LiDAR, or the like. As described above, any sensor or combinations of sensors 70 may be used to detect and monitor the oncoming vehicle 32 and/or any other target object. Other V2V and/or V2I capable vehicles, such as the oncoming vehicle 32 of FIG. 1 may include any one or more of the components described above for communication between vehicles, including the object vehicle 10.

Figure 3:
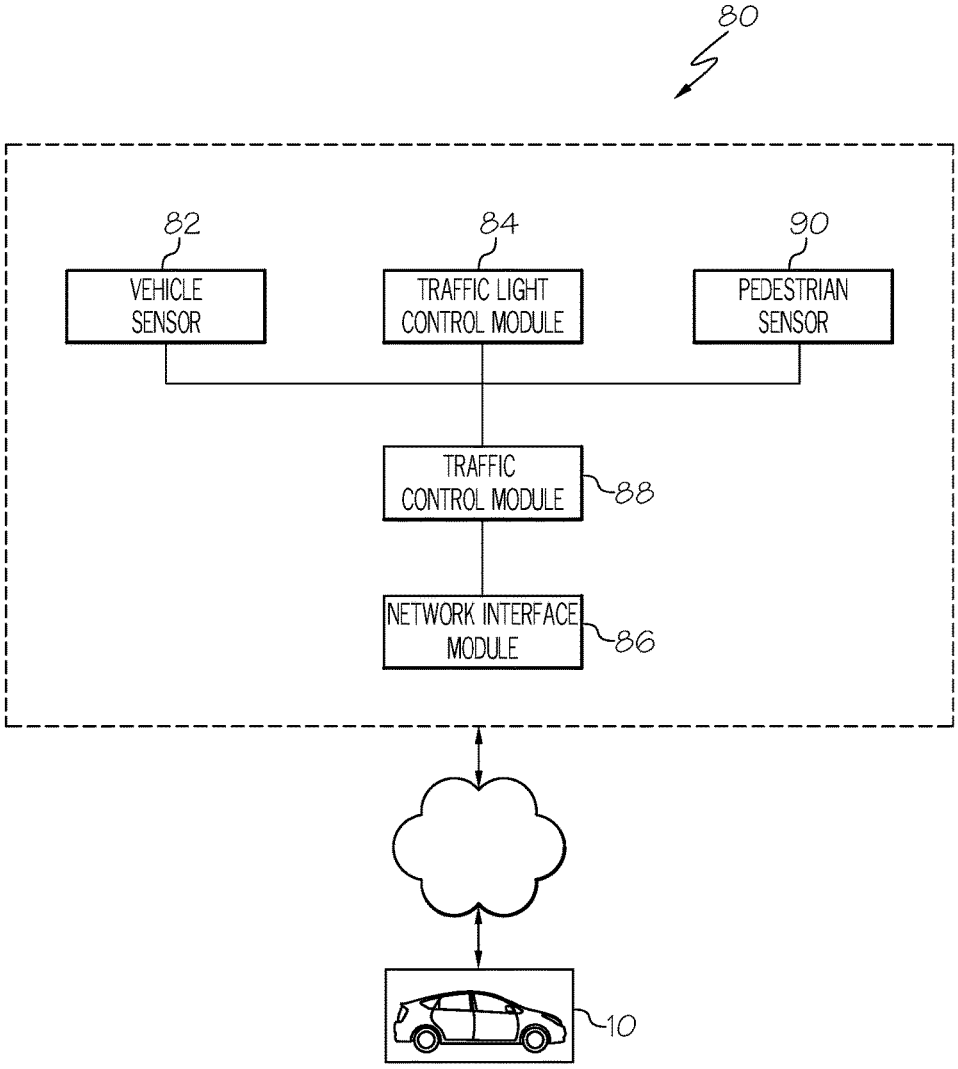
FIG. 3 is a schematic illustration of a roadside traffic control apparatus suitable for controlling a traffic signal apparatus depicted by FIG. 1, according to one or more embodiments shown and described herein.

Referring to FIG. 3, an exemplary embodiment of the object vehicle 10 is illustrated in which the object vehicle 10 uses a roadside traffic control apparatus 80 in a V2I manner in which the object vehicle 10 receives current traffic signal status information from the roadside traffic control apparatus 80. The roadside traffic control apparatus 80 may include a vehicle sensor 82, a traffic light control module 84, network interface module 86 for communicatively coupling to the object vehicle 10 and a traffic control module 88 that sends and receives information from the vehicle sensor 82, traffic light control module 84 and network interface module 86. In some embodiments, a pedestrian sensor 90 may be provided; particularly where cross walks are present. The traffic control module 88 can utilize information from the vehicle and pedestrian sensors 82 and 90 to control operation of the traffic light control module 84. In some embodiments, the traffic light control module 84 can provide current traffic light status information to the traffic control module 88, which can then be provided to the object vehicle 10.

Figure 4:
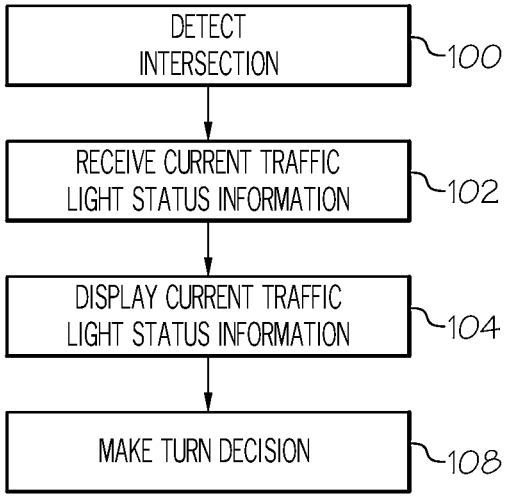
FIG. 4 illustrates a method of providing current traffic light status information to a driver of an object vehicle for one or more traffic light devices at an intersection, according to one or more embodiments shown and described herein.

In operation, referring to FIG. 4, the object vehicle 10 may detect presence of an intersection or of an approach thereto at step 100. The object vehicle 10 may detect presence of the intersection in any suitable manner, such as through image recognition, GPS, traffic information stored in memory, from other vehicles (V2V), etc. The object vehicle 10 may also detect presence of the intersection using the roadside traffic control apparatus 80 of FIG. 3. For example, the roadside traffic control apparatus 80 may periodically poll the surrounding area using the network interface module 86 to determine presence of vehicles and to provide vehicles an indication of presence of the roadside traffic control apparatus 80. At step 102, the object vehicle 10 may receive current traffic light status information from the roadside traffic control apparatus 80 and/or from other vehicles at the intersection. The object vehicle 10 may receive current traffic light status information from the roadside traffic control apparatus 80 and/or the other vehicles at the intersection based on a request from the object vehicle 10. In some embodiments, the roadside traffic control apparatus 80 and/or other vehicles at the intersection may provide the current traffic light status information continuously, automatically and/or upon determination of presence of the object vehicle 10.

The current traffic light status information received by the object vehicle 10 may be controlled by the roadside traffic control apparatus 80 and/or the other vehicles at the intersection. For example, the roadside traffic control apparatus 80 may provide current traffic light status information for only those traffic signal devices having vehicles within their associated lanes (FIG. 1), as detected using the vehicle sensor 82. As another example, the roadside traffic control apparatus 80 may provide current traffic light status information for traffic signal devices of only certain, predetermined lanes, such as a turn lane. As yet another example, the roadside traffic control apparatus 80 may provide traffic light status information for traffic signal devices of all lanes of the intersection. Vehicles at the intersection may provide current traffic light status information for traffic signal devices of only their associated lane or for any traffic signal device detectable by the particular vehicle. Current traffic light status information may be pooled together from a number of vehicles at the intersection. The object vehicle 10 can determine whether or not to use any or all of the traffic light status information pertaining to the various traffic signal devices depending, for example, on the lane the object vehicle 10 is currently in, customization by the driver, driver selection from various lane options, objects detected in the vicinity of the object vehicle 10, etc.

Figure 5:
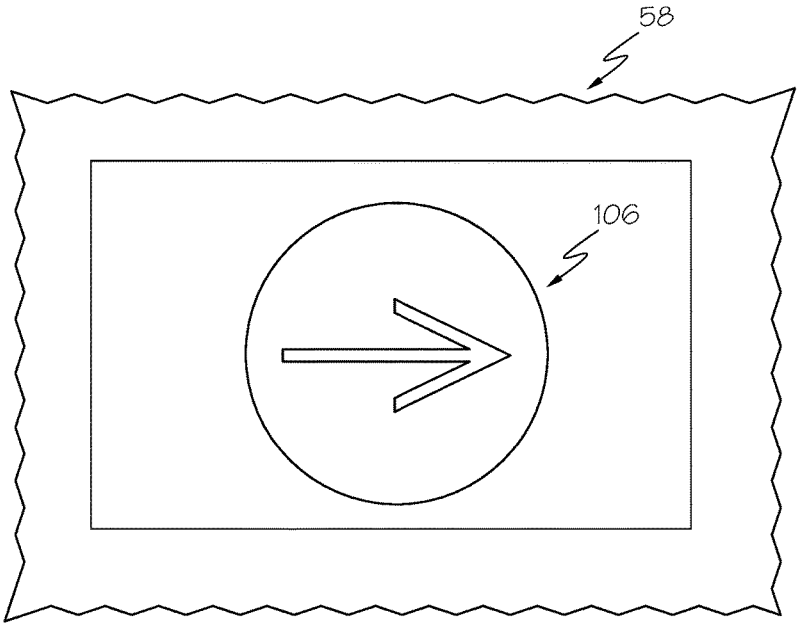
FIG. 5 is a schematic illustration of a reproduction of a traffic light visible to an oncoming vehicle as a graphic object on a display of vehicle of FIG. 1 generated using traffic light status information, according to one or more embodiments shown and described herein.

At step 104, the object vehicle 10 displays current traffic light status information to the driver of the object vehicle 10. Referring briefly to FIG. 5, for example, the current traffic light status information can be used by the intersection traffic signal indicator system 50 to display on the display 58 a traffic signal reproduction 106 of the traffic flow instruction being displayed by the associated traffic signal device (as an activated, illuminated traffic light) to an oncoming vehicle. In the example of FIG. 1, the display 58 of the object vehicle 10 may display a green or yellow arrow indicating that the oncoming vehicle 32 can turn onto the roadway 42. As used herein, the term "reproduction" refers to a graphic object that is made to look like the original, real object. The reproduction may include shape, color, duration (e.g., blinking light), etc. This information can be used by the driver of the object vehicle 10 to make a more informed turn decision at step 108, for example, as to whether or not to make a right turn onto the roadway 42 with red light traffic flow instructions.

Figure 6:
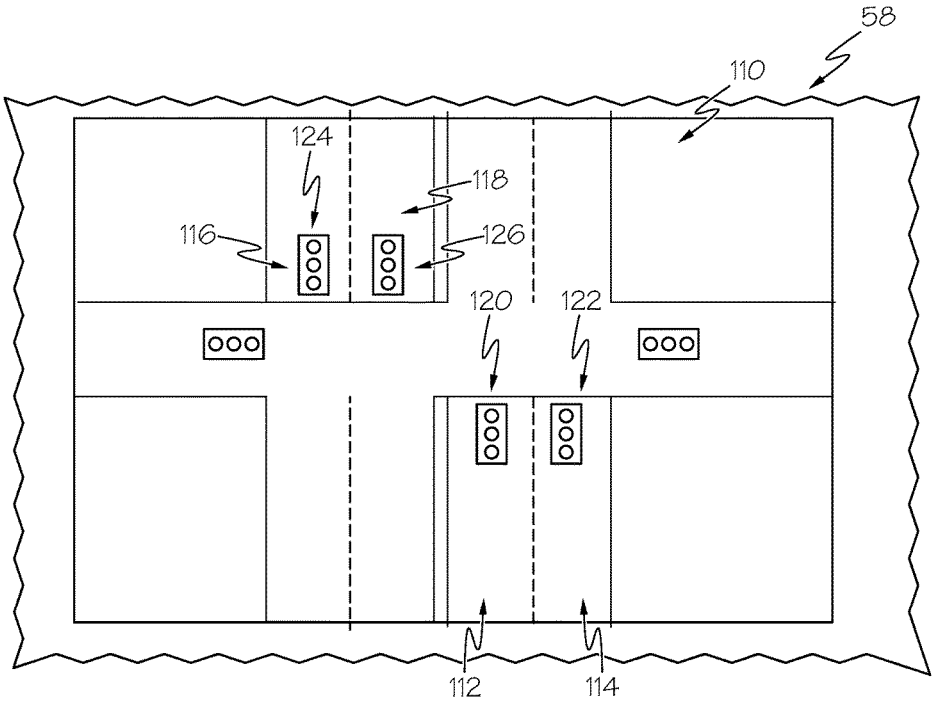
FIG. 6 is a schematic illustration of a reproduction of an intersection and traffic light visible to vehicles as graphic objects on a display of vehicle of FIG. 1 generated using traffic light status information, according to one or more embodiments shown and described herein.

Referring to FIG. 6, current traffic light status information can be displayed to the driver in various ways. In some embodiments, current traffic light status information may be displayed for traffic signal devices of all lanes of an intersection. In this embodiment, an intersection reproduction 110 may be displayed by the display 58. The intersection reproduction 110 can be generated from, for example, GPS information, map information saved in memory, information provided V2V and/or V2I, image recognition, etc. The intersection reproduction 110 may include various lane reproductions 112, 114, 116 and 118 associated with the corresponding intersection. Current traffic light status information can be displayed as traffic signal reproductions 120, 122, 124 and 126 for traffic signal devices of each of the lane reproductions 112, 114, 116 and 118. Each traffic signal reproduction 120, 122, 124 and 126 may be associated graphically with the particular lane reproduction 112, 114, 116 and 118 they are associated with. Such an arrangement can provide the driver with an intuitive reproduction of current traffic light status available for vehicles at the intersection.

The intersection traffic signal indicator system 50 can be customized by the driver in accordance with driver preferences. For example, the intersection traffic signal indicator system 50 may be customized to display reproductions of a certain one, some or all of the traffic signal devices of lanes of an intersection. When the reproductions are displayed may also be selected by the driver. For example, the reproductions of the traffic signal devices may be displayed upon approach with an intersection and/or when stopped at an intersection. Any suitable display arrangement based on driver preferences can be selected.

The above-described intersection traffic signal indicator systems allow a vehicle driver to determine whether or not a vehicle at an intersection has the "go ahead" to turn into traffic. The object vehicle can utilize V2V or V2I to determine the status of an opposing or any other traffic light status at an intersection and display a reproduction of the traffic light, or even the entire traffic light device with traffic light on one or more vehicle display. Providing the status of other traffic lights at an intersection can provide the driver of the object vehicle with traffic signal information to make a more informed decision as to whether or not to execute a move, such as a turn, while stopped at the intersection.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A method of providing current traffic light status information to a driver of an object vehicle for one or more traffic light devices at an intersection, the method comprising:

receiving current traffic light status information by an intersection traffic signal indicator system of the object vehicle from a source external the object vehicle using one or both of vehicle-to-vehicle and vehicle-to-infrastructure communication, the current traffic light status information being indicative of a traffic light of a traffic light device where the traffic light of the traffic light device is facing toward an oncoming vehicle and away from the object vehicle;

displaying a reproduction of the traffic light facing toward the oncoming vehicle as a graphic object on a display of the object vehicle using the current traffic light status information; and displaying a reproduction of multiple traffic lights at the intersection as graphic objects on the display using traffic light status information.

2. The method of claim 1, wherein the current traffic light status information is received by the object vehicle from the oncoming vehicle.

3. The method of claim 1, wherein the current traffic light status information is received by the object vehicle from a roadside traffic control apparatus configured to control operation of the traffic light device.

4. The method of claim 1, wherein the current traffic light status information is received by the object vehicle from multiple vehicles at the intersection.

5. The method of claim 1, wherein displaying the reproduction of the traffic light visible to the oncoming vehicle occurs only with the object vehicle within a predetermined range from the intersection.

6. The method of claim 1 further comprising displaying a reproduction of the intersection on the display.

7. The method of claim 1 further comprising associating the graphic object with a lane of the reproduction of the intersection corresponding to a lane of the oncoming vehicle.

8. A method of providing current traffic light status information to a driver of an object vehicle for one or more traffic light devices at an intersection, the method comprising:

receiving current traffic light status information by an intersection traffic signal indicator system of the object vehicle from a source external the object vehicle using one or both of vehicle-to-vehicle and vehicle-to-infrastructure communication, the current traffic light status information being indicative of a traffic light of a traffic light device at the intersection including where the traffic light device is facing toward an oncoming vehicle and away from the object vehicle; and displaying a reproduction of one or more traffic lights including the traffic light device facing toward the oncoming vehicle as a graphic object on a display of the object vehicle using the traffic light status information.

9. The method of claim 8, wherein the current traffic light status information is received by the object vehicle from an oncoming vehicle.

10. The method of claim 8, wherein the current traffic light status information is received by the object vehicle from a roadside traffic control apparatus configured to control operation of the traffic light device.

11. The method of claim 8, wherein the current traffic light status information is received by the object vehicle from multiple vehicles at the intersection.

12. The method of claim 8, wherein displaying the reproduction of the one or more traffic lights occurs only with the object vehicle within a predetermined range from the intersection.

13. The method of claim 8 further comprising displaying a reproduction of the intersection on the display.

14. The method of claim 13 further comprising associating the graphic object with a lane of the reproduction of the intersection.

15. A vehicle comprising:

one or more processors;

one or more memory modules communicatively coupled to the one or more processors;

a network interface module configured for one or both of vehicle-to-vehicle and vehicle-to-infrastructure communication;

a display;

machine readable instructions stored in the one or more memory modules that cause the one or more processors to display a reproduction of a traffic light of a traffic light device at an intersection as a graphic object on the display of the vehicle using traffic light status information received from a source external of the vehicle using one or both of vehicle-to-vehicle and vehicle-to-infrastructure communication, the current traffic light status information being indicative of the traffic light of the traffic light device at the intersection;

wherein the traffic light of the traffic light device is facing toward an oncoming vehicle and away from the object vehicle; and wherein the machine readable instructions cause the one or more processors to display a reproduction of multiple traffic lights at the intersection as graphic objects on the display using traffic light status information.

16. The vehicle of claim 15, wherein the reproduction of the traffic light of the traffic light device is displayed only with the vehicle within a predetermined range from the intersection.

17. The vehicle of claim 15, wherein the machine readable instructions cause the one or more processors to display a reproduction of the intersection on the display.

18. The vehicle of claim 17, wherein the machine readable instructions cause the one or more processors to associate the graphic object with a lane of the reproduction of the intersection.

* * * * *